US012778378B2

(12) United States Patent
Meyer et al.

(10) Patent No.: US 12,778,378 B2
(45) Date of Patent: Nov. 3, 2026

(54) FLOORMAT

(71) Applicants: Stafford Vaughey Meyer, Bronxville, NJ (US); Brian Potempa, Freeport, IL (US); Michael Potempa, Freeport, IL (US)

(72) Inventors: Stafford Vaughey Meyer, Bronxville, NJ (US); Brian Potempa, Freeport, IL (US); Michael Potempa, Freeport, IL (US)

(73) Assignee: Porte + Hall, Inc., Bronxville, NY (US)

( * ) Notice: Subject to any disclaimer, the term of this patent is extended or adjusted under 35 U.S.C. 154(b) by 307 days.

(21) Appl. No.: 18/653,637

(22) Filed: May 2, 2024

(65) Prior Publication Data

US 2024/0366060 A1 Nov. 7, 2024

Related U.S. Application Data

(60) Provisional application No. 63/499,972, filed on May 3, 2023.

(51) Int. Cl.
*A47L 23/26* (2006.01)

(52) U.S. Cl.
CPC ..... *A47L 23/266* (2013.01)

(58) Field of Classification Search
CPC ..... A47L 23/266
USPC ..... 15/104.001
See application file for complete search history.

(56) References Cited

U.S. PATENT DOCUMENTS 3,696,459 A * 10/1972 Kucera ..... A47L 23/266 15/217
5,077,858 A * 1/1992 Lewis, Jr. ..... A47L 23/266 15/217
6,647,564 B1 * 11/2003 Smith ..... A47K 7/024 4/606
6,884,489 B2 * 4/2005 Kessler ..... A47L 23/26 428/44
10,736,485 B1 * 8/2020 Galbraith ..... A47L 23/266
2002/0119275 A1 * 8/2002 Williamson ..... E04F 19/10 428/44
2004/0021617 A1 * 2/2004 Blum ..... A47L 23/22 345/1.3
2007/0258255 A1 * 11/2007 Kessler ..... A47L 23/266 362/487
2013/0298483 A1 * 11/2013 Chen ..... E04F 15/02161 52/177
2015/0307067 A1 * 10/2015 Movsesian ..... B60S 3/042 15/210.1
2021/0032876 A1 * 2/2021 Neill ..... E04F 15/107
2021/0076901 A1 * 3/2021 Egan ..... A47L 23/266
(Continued)

FOREIGN PATENT DOCUMENTS

AT 522048 B1 * 7/2020 ..... A47L 23/266
DE 202004013301 U1 * 12/2004 ..... A47L 23/266
(Continued)

*Primary Examiner* — Marc Carlson

(57) ABSTRACT

A floormat provides a frame. The frame contains a plurality of scrubber insert chambers. A scrubber insert is placed within each scrubber insert chamber. The scrubber inserts may or may not be identical. The scrubber inserts have a number of nubs. The nubs shown in the embodiment generally are truncated cones, although the nubs could be of any shape or size for the desired use. The nubs need not be identical.

21 Claims, 6 Drawing Sheets

(56) References Cited

U.S. PATENT DOCUMENTS

| | | | | |
|---|---|---|---|---|
| 2021/0121025 | A1* | 4/2021 | Palacios | A47K 7/024 |
| 2023/0079201 | A1* | 3/2023 | Shock | A47L 23/266<br>15/237 |

FOREIGN PATENT DOCUMENTS

| | | | | | |
|---|---|---|---|---|---|
| DE | 102005030278 | B3 | * | 1/2007 | A47L 23/266 |
| DE | 102021131861 | A1 | * | 6/2022 | A47L 23/266 |
| GB | 2513595 | A | * | 11/2014 | A47L 23/266 |
| IT | 201900000055 | A1 | * | 7/2020 | A47L 23/26 |
| KR | 20210004311 | A | * | 1/2021 | A47L 23/22 |
| KR | 102230294 | B1 | * | 3/2021 | A47L 23/263 |
| KR | 102302697 | B1 | * | 9/2021 | A47L 23/266 |
| WO | WO-2006005972 | A1 | * | 1/2006 | A47L 23/24 |
| WO | WO-2007122399 | A1 | * | 11/2007 | A47L 23/26 |
| WO | WO-2022049155 | A1 | * | 3/2022 | A47L 23/266 |

* cited by examiner

FLOORMAT

CLAIM OF PRIORITY

Applicant claims priority to U.S. Provisional Application 63/499,972, entitled IMPROVED FLOORMAT, filed May 2, 2023.

FIELD OF THE INVENTION

This invention relates to a floormat and a method of manufacturing the same.

BACKGROUND OF THE INVENTION

Protective floormats are used extensively for a variety of tasks. Floormats are mainly used to provide a surface to separate a user from the floor. They also protect the floor from contact with liquid, solids, and other contaminants which might damage the floor. Floormats can also save the floor from scratches and damage caused by extended use.

Another common type of floormat is the exterior floormat. A floormat is a more or less flat mat lying near the entrance of a house or other building. The floormat provides a surface for people to wipe or scrub the soles of their shoes or feet to remove water, snow, mud, dirt, or other debris before entering the building.

Floormats are often made as a single panel made from materials such as, for example, nylon, aluminum, and rubber.

Multi-layer floormats have an upper layer and a lower layer. The upper layer has a system, such as a network of bristles, for removing dirt, debris, snow, etc., from shoes. The upper layer is fused or bonded to the lower layer. The lower layer generally has some means to be removably attached to the floor so that the floormat will not slide. The lower layer usually consists of rubber. Sometimes, metal is infused within the lower layer to provide additional stability and increase the lifespan of the floormat. The lower layer may have a variety of channels and drainage holes for diverting water and debris from the upper layer.

The type of debris and water removed from shoes by floormats may vary depending upon the locale of its use. For example, a floormat used in Alaska should be designed to remove snow, dirt, and mud from shoes. Such a floormat might have very rigid bristles, such as those made from metal. Such a floormat, however, would not be acceptable for use on the Florida coast to remove sand and water from sandals and bare feet. A desirable floormat for the coast of Florida might have a softer surface and a means for dealing with copious amounts of sand.

Additionally, due to the prominent display of the floormat, there is a desire for a floormat to have an attractive, decorative design. Such a decorative design may increase the visual appeal of the floormat and the entryway into the building.

There is also the need to make floormats more environmentally friendly. The number of floormats used throughout the world is considerable. Making floormats of recyclable material would be advantageous.

The differing requirements resulting from various functional and aesthetic demands complicate the manufacture of floormats. Usually, floormat manufacturers have many different processes for the manufacture of each type of floormat. This increases the floormat's cost, resulting in increased costs for the consumer.

An improved floormat is needed, which simplifies the manufacturing process and provides for superior functional and aesthetic elements.

SUMMARY OF THE INVENTION

In accordance with the invention, a floormat is providing having a frame. The frame contains a plurality of scrubber insert chambers. A scrubber insert is placed within each scrubber insert chamber. The scrubber inserts may or may not be identical.

Each scrubber insert chamber includes a cross-member. The cross-member has two support bars generally parallel to the length of the floormat and two support bars generally parallel to the width of the floormat. Thus, the two pairs of support bars are generally perpendicular to each other.

The scrubber inserts have a number of nubs. The nubs shown in the embodiment generally are truncated cones, although the nubs could be of any shape or size for the desired use. The nubs need not be identical.

Wiper perimeters are placed within the array of nubs. In the shown embodiment, the wiper perimeter forms a square. The wiper perimeters could be configured in many different ways. The wiper perimeters and the nubs work together to clean mud, dirt, and other debris from the bottom of shoes.

The scrubber inserts could be of many different types and styles. The scrubber inserts could create a decorative design on the floormat.

The floormat could be made from chlorinated polyethylene (CPE), Santoprene, or styrene-ethylene-butadiene-styrene block copolymer (SEBs). Preferably, the floormat is formed from blends of polymeric materials, including a sustainable polymeric material formed from plant sources and/or polymeric carbohydrate material. All or substantially all of the polymeric content of the article could be formed from polymers sourced from plant sources. Using such materials, the floormat would be completely recyclable.

DETAILED DESCRIPTION OF THE DRAWING

The drawings describe in detail a specific embodiment of the invention. However, the disclosure is an example of various aspects and principles of the design and is not intended to limit the invention. Elements and limitations that are disclosed but not explicitly outlined and outlined in the claims should not be incorporated into the claims.

The present disclosure is directed to a floormat that could be made from various materials such as chlorinated polyethylene (CPE), Santoprene, or styrene-ethylene-butadiene-styrene block copolymer (SEBs). Preferably, the floormat is formed from blends of polymeric materials, including a sustainable polymeric material formed from plant sources and/or polymeric carbohydrate material. All or substantially all of the polymeric content of the article could be formed from polymers sourced from plant sources. From a sustainability perspective, such characteristics are particularly advantageous for increased recyclability and decreased carbon footprint. Preferably, the floormat is entirely recyclable.

Figure 1:
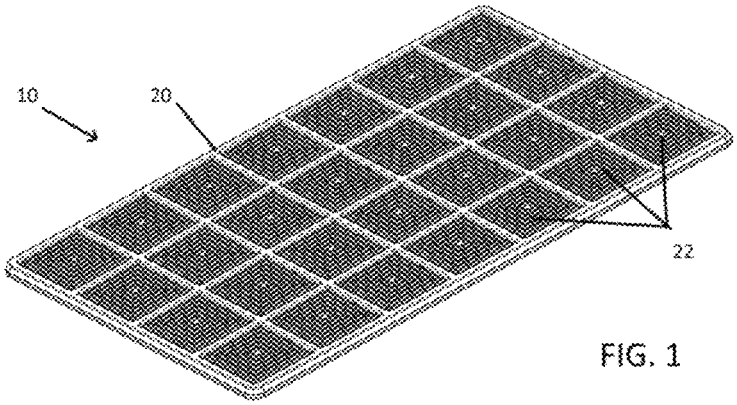
FIG. 1 shows a floormat in accordance with the invention described herein.

FIG. 1 shows a floormat 10 in accordance with the invention described herein. The floormat 10 includes a frame 20 and a plurality of scrubber inserts 22. For simplicity, only three of the twenty-eight scrubbers shown are numbered. The scrubber inserts 22 shown in FIG. 1 are identical. However, it is possible that the scrubber inserts 22 contained within the frame 12 could have different functional qualities and aesthetic designs.

Figure 2:
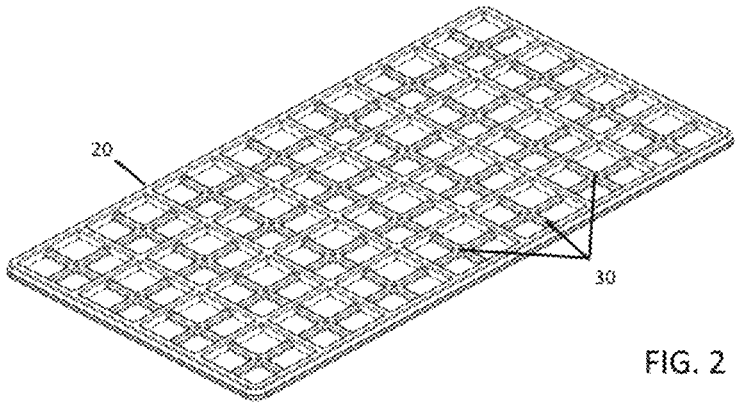
FIG. 2 shows the frame of the floormat of FIG. 1.

FIG. 2 shows the frame 20. As can be easily seen, there is a plurality of twenty-eight scrubber insert chambers 30 within the frame 20. Each scrubber insert chamber 30 contains a scrubber insert 22.

Figure 3:
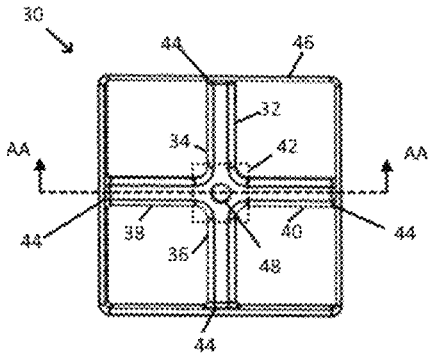
FIG. 3 is a top view of a single scrubber insert chamber.
Figure 4:
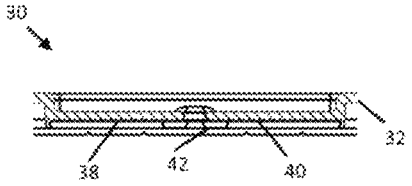
FIG. 4 is a cross-sectional view of the single scrubber insert chamber.
Figure 5:
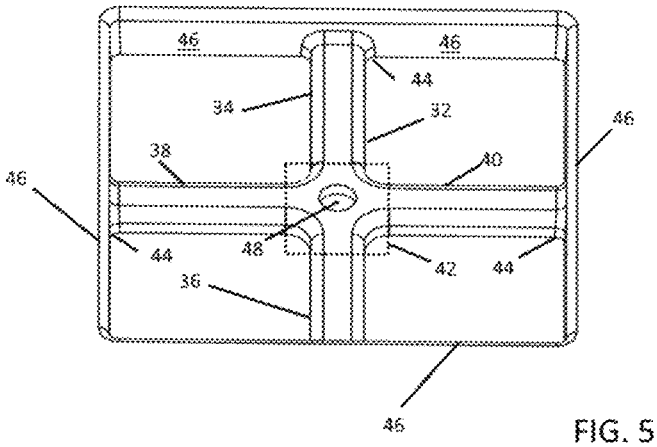
FIG. 5 is a perspective view of the single scrubber insert chamber.
Figure 6:
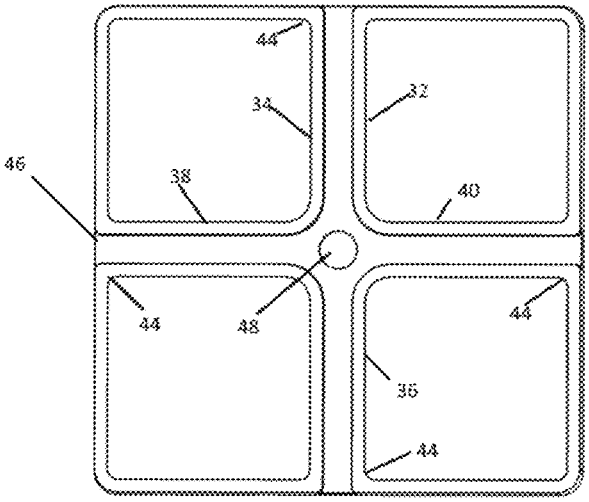
FIG. 6 is a bottom view of the single scrubber insert chamber.

FIG. 3 is a top view of a single scrubber insert chamber 30 from the frame 20. FIG. 4 is a cross-sectional view of the single scrubber insert chamber 30 of FIG. 3 along line AA. FIG. 5 is a perspective view of the single scrubber insert chamber 30. FIG. 6 is a bottom view of the single scrubber insert chamber 30.

Referring to FIG. 3, FIG. 4, and FIG. 5, scrubber insert chamber 30 includes a cross-member 32. The cross-member 32 has two lengthwise support bars 34, 36, generally parallel to the length of the floormat 10, and two widthwise support bars 38, 40, generally parallel to the width of the floormat 10. The lengthwise support bars 34, 36 and widthwise support bars 38, 40 are joined in the middle of scrubber insert chamber 30 by center support 42. The lengthwise support bars 34, 36 and the widthwise support bars 38, 40 are generally hexagonal even though the bottom wall of the hexagon could be omitted, thus creating a cavity beneath the support bars 34, 36, 38, 40. These cavities allow water to flow out from under the mat.

The lengthwise support bars 34, 36 and widthwise support bars 38, 40 are each attached to the frame wall 46 by attachment collars 44. Center support 42 include orifice 48. As noted previously, the scrubber insert 22 shown in this embodiment are identical to all the other scrubber inserts 22. However, the scrubber inserts 22 could vary both stylistically and functionally depending upon the application.

Figure 7:
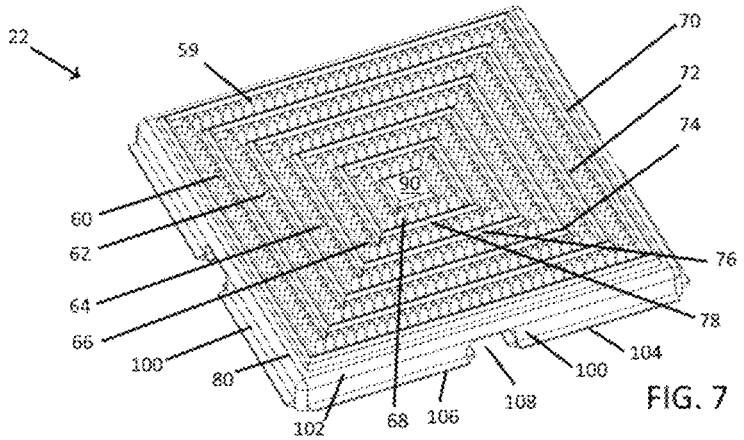
FIG. 7 is a perspective view of one scrubber insert.
Figure 8:
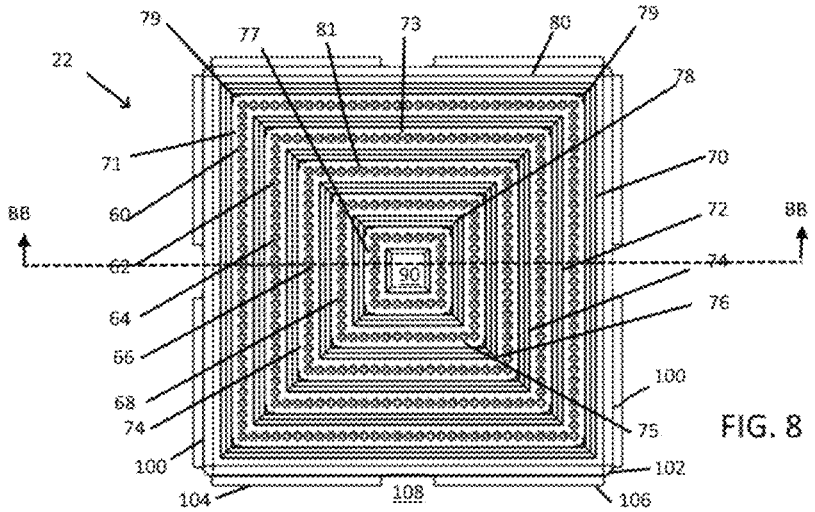
FIG. 8 is a top view of the scrubber insert.
Figure 9:
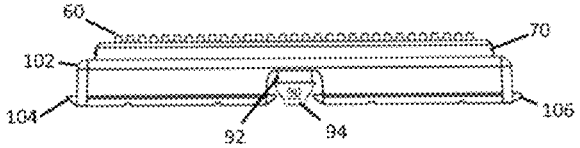
FIG. 9 is a side view of the scrubber insert.
Figure 10:
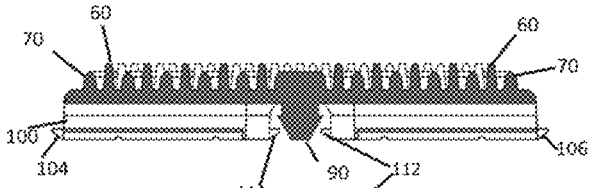
FIG. 10 is a cross-sectional view of the scrubber insert.
Figure 11:
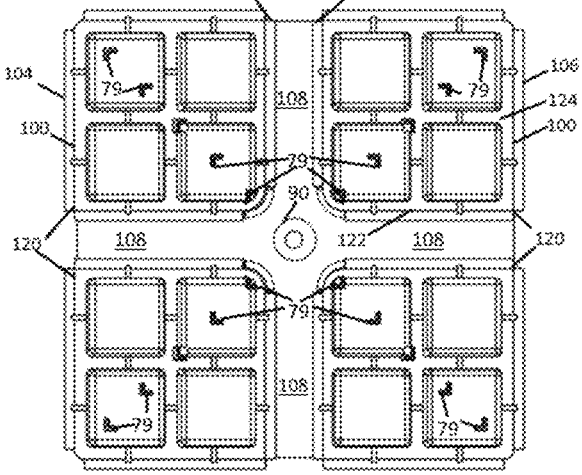
FIG. 11 is a bottom view of the scrubber insert.
Figure 12:
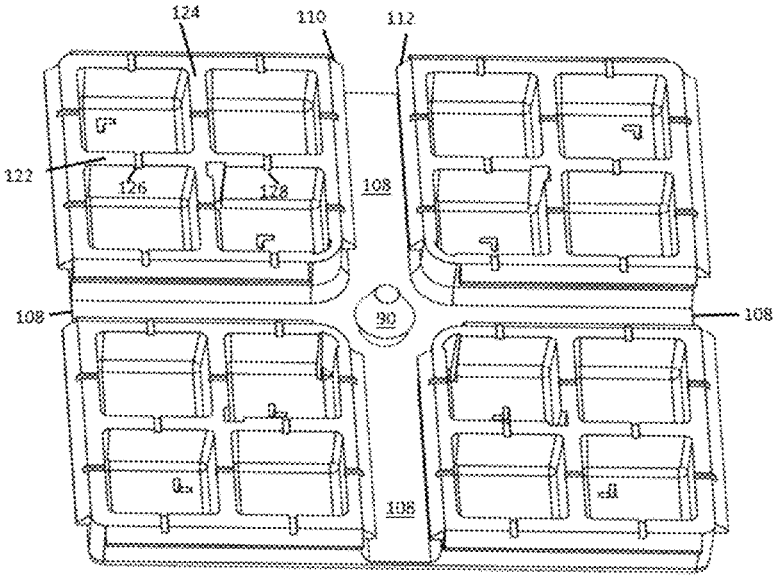
FIG. 12 is a perspective view of the bottom of the scrubber insert.

FIG. 7 is a perspective view of one scrubber insert 22. FIG. 8 is top view of the scrubber insert 22. FIG. 9 is a side view of the scrubber insert 22. FIG. 10 is a cross-sectional view of the scrubber insert 22 along line BB, as shown in FIG. 7. FIG. 11 is a bottom view of the scrubber insert 22. FIG. 12 is a perspective view of the bottom of the scrubber insert 22.

As show in FIG. 7, FIG. 8, FIG. 9, FIG. 10, FIG. 11 and FIG. 12, the scrubber insert 22 is shown in this embodiment to be generally square. However, the scrubber insert 22 could be of many different shapes and sizes.

The scrubber insert 22 includes a plurality of nubs 59. The nubs 59 are generally truncated cones. In other embodiments, the nubs 59 could be of any shape and size for the desired application. Additionally, the nubs 59 need not be identical.

The nubs 59 are arranged in an outer nub perimeter 60, a first middle nub perimeter 62, a second middle nub perimeter 64, a third middle nub perimeter 66, and an inner nub perimeter 68. The nub perimeters 60, 62, 64, 66, 68 shown in this embodiment are generally square. However, the nub perimeters 60, 62, 64, 66, 68 could be any shape or style.

Wiper perimeters 70, 72, 74, 76, 78 are interspersed within the nub perimeters 60, 62, 64, 66, 68. Each wiper perimeter 70, 72, 74, 76, 78 is composed of four walls that intersect to form a rectangle, which, in this embodiment, is a square. However, the wiper perimeters 70, 72, 74, 76, 78 could be any shape or style required by the desired use. In some embodiments, the wiper perimeters 70, 72, 74, 76, 78 might be omitted.

The wiper perimeters 70, 72, 74, 76, 78 form the upper channels 71, 73, 75, 77, 81. The scrubber insert 22 has a plurality of drains 79. To assist in understanding the drawings, not all drains 79 are numbered in FIG. 8. The drains 79 are located at the corners of each wiper perimeter. Thus, wiper perimeter 70 has four associated drains 79. Similarly, wiper perimeter 72 has four associated drains, as does wiper perimeters 72, 74, 76, 78.

The upper channel 71 will hereinafter be described. However, the upper channels 73, 75, 77, 81 have a similar construction. The upper channel 71 is bounded by the wiper perimeter 72 and the wiper perimeter 74. Within the upper channel 71 is the nub perimeter 60 and the four drains 79. Water that might collect within the upper channel 71 will flow through the scrub insert 22 and move underneath scrub insert 22.

The upper channels 71, 73, 75, 77, 81 are shown as square. However, the upper channels 71, 73, 75, 77, 81 could be circular, curved, rectangular or any other shape which might be visually appealing while simultaneously functional. Additionally, the upper channels 71, 73, 75, 77, 81 need not be closed. For example, the upper channels 71, 73, 75, 77, 81 could extend only lengthwise, widthwise, or in a wave pattern across the scrubber insert 22.

The nubs 59 and the wiper perimeters 70, 72, 74, 76, 78 work in concert to clean debris, such as mud, from the bottom of the shoes. As a user rubs his shoes across the floormat 10, the nubs 59 penetrate the mud and break the debris into smaller parts. The wiper perimeters 70, 72, 74, 76, 78 can dislodge the debris from the shoes.

The nubs 59 extend upward from the scrubber insert base 80. The wiper perimeters 70, 72, 74, 76, 78 extend upward from the scrubber insert base 80, albeit less than the nubs 59. During use, the nubs 59 will deflect and bend when a person moves his feet back and forth across the floormat 10. As the nubs 59 deflect, the shoes will come in contact with the wiper perimeters 70, 72, 74, 76, 78, and thus facilitate the removal of the debris from the bottom of the shoes.

A connector 90 extends downward from the scrubber insert base 80. The connector 90 has an upper cylindrical portion 92 and a conical portion 94. The diameter of the base of the conical portion 94 is slightly larger than the diameter of the cylindrical portion 92.

During manufacture, the connector 90 is urged into the orifice 48 of the scrubber insert chamber 30. The diameter of the orifice 48 is somewhat smaller than the diameter of the base of the conical portion 94. The diameter of the orifice 48 is about the same as the diameter of the upper cylindrical portion 92.

During assembly of the floormat 20, the conical portion 94 deforms as it is pushed into orifice 48. After it passes through orifice 48, it returns to its original shape and size, thereby assisting in attaching the scrubber insert 22 to the scrubber insert chamber 30.

The scrubber insert 22 has four walls 100 on each side of the scrubber insert 22. Each wall 100 extends downward from the base, forming a cavity within the scrubber insert 22. Each wall 100 has a shoulder 102, a first flap 104, a second flap 106, and a curved channel 108. In FIG. 9 and FIG. 10, the connector 90 is shown within the curved channel 108. There are four curved channels 108 for the scrubber insert 22.

Referring primarily to FIG. 11 and FIG. 12, each curved channel 108 generally has the same shape and size as the lengthwise support bars 34, 36 and the widthwise support bars 38, 40. The curved channel 108 further includes a first channel flap 110 and a second channel flap 112. When the scrubber insert 22 is urged into the scrubber insert chamber 30, the first channel flap 110 and the second channel flap 112 deform so as to allow the scrubber insert 22 to be placed into the scrubber insert chamber 30. When the scrubber insert 22 is entirely within the scrubber insert chamber 30, the first channel flap 110 and the second channel flap 112 return to their original shape and size, thereby assisting in maintaining the scrubber insert 22 within the scrubber insert chamber 30.

The curved channels 108 and the wall 100 form four boxes 120 within the scrubber insert 22. Each box 120 has a first member 122 and a second member 124. Each member 122, 124 has a first drainage channel 126 and a second drainage channel 128. The drainage channels 126, 128 facilitate the movement of water that might accumulate under the floormat 10. The four boxes 120, the associated first member 122, and the second member 124 create a platform to stabilize the scrubber insert 22.

Figure 13:
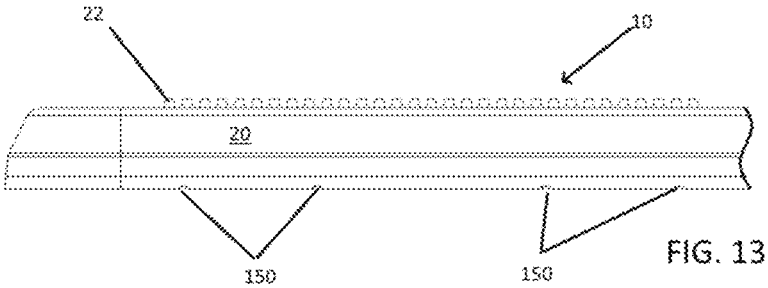
FIG. 13 is a side view of a portion of the floormat.

FIG. 13 shows a side view of the end of the floormat 10. The drainage notches 150 allow water that would otherwise be trapped under the floormat 10 to flow outward.

The desirability of a floormat 10 designed in accordance with the invention described herein also relates to the manufacture of the floormat 20. A single frame 20 can be used for multiple applications. Different scrubber inserts can be used for different uses and offer numerous enhanced appearances.

Thus, separate runs of an entire floormat are not required. Instead, the same frame is used across multiple types and designs of floormats. The manufacturing inventory would consist of relatively few types of frames with many different types of scrubber inserts. Customization of the floormats for additional and differing requirements is thus greatly simplified.

While the invention has been disclosed in preferred forms, it will be apparent to those skilled in the art that many modifications, additions, and deletions can be made therein, especially in matters of shape, size, and arrangement of parts used to carry out the disclosed embodiments, without departing from the spirit and scope of the invention and its equivalents as set forth in the claims. Therefore, other modification or embodiments as may be suggested by the teachings herein are particularly reserved especially as they fall within the breadth and scope of the claims here appended.

The invention claimed is:

1. An improved floormat comprising:

a frame;

a plurality of scrubber insert chambers within the said frame; and a plurality of scrubber inserts with base and equivalent to be inserted within the said scrubber insert chambers; and a connector jutting from the base of the said scrubber inserts, the connector having an upper cylindrical portion and a conical portion, extends downward from the said scrubber insert base.

2. The floor mat of claim 1, wherein each of the said scrubber insert chamber comprises a cross-sectional member having two lengthwise and two widthwise support bars each being parallel to the length and width of the floormat respectively, wherein the said support bars are joined in the center of the said scrubber insert chamber by a center support having an orifice.

3. The floor mat of claim 2, wherein the said lengthwise and widthwise support bars are attached to the frame wall by a plurality of attachment collars.

4. The floormat of claim 2, wherein, the diameter of the base of the conical portion of the said connector is larger than the diameter of the said cylindrical portion.

5. The floormat of claim 2 wherein, during assembly of the said scrubber insert with the said scrubber insert chamber, the said connecter of the said scrubber insert base, is inserted into the said orifice of the said scrubber insert chamber, wherein the said conical portion deforms when urged into the orifice and returns to its original shape and size once the insertion is complete, facilitating the insertion of the scrubber insert into the said scrubber insert chamber.

6. The said floormat of claim 1, wherein the said scrubber inserts include a plurality of nubs arranged in a row, lining the perimeter of the said scrubber insert and forming a nub perimeter having a square shape and wherein the said nub perimeter formed are in plurality and wherein the said nubs extend upward from the said scrubber insert base.

7. The said floormat of claim 6, wherein the said nub perimeter formed is rectangular in shape.

8. The said floormat of claim 6, wherein the said nub perimeter formed conforms with the shape of the said scrubber insert.

9. The said floormat of claim 6, wherein, interspersed between the said nub perimeters are wiper perimeters, wherein each said wiper perimeter comprises four walls intersecting to form a ninety-degree angle and wherein the said wiper perimeters extend upwards from the said scrubber insert base.

10. The said floormat of claim 9, wherein the upward extension of the said nubs from the said scrubber insert base is greater than the extension of the wiper perimeter from the said scrubber base insert.

11. The floormat of claim 9, wherein the wiper perimeter formed, conforms with the shape of the said scrubber insert and the said nub perimeter.

12. The floormat of claim 9, wherein the said each wiper perimeter has associated four drains positioned at the intersecting corners of each wiper perimeter and wherein each of the said wiper perimeter forms an upper channel.

13. The floormat of claim 12, wherein the said each upper channel of the said wiper perimeter is bounded by each of the succeeding and preceding wiper perimeter and within which lies the said nub perimeter.

14. The floormat of claim 1, wherein the said scrubber insert has a bottom surface, and the bottom surface has four walls, extending downward from the base and forming a cavity within the scrubber insert.

15. The floormat of claim 14, wherein, the each of the said four walls has a shoulder, a first flap, a second flap and a curved channel.

16. The floormat of claim 15, wherein the said curved channel is further provided with a first channel flap and a second channel flap which deform to allow the said scrubber insert to be placed into the scrubber insert chamber during assembly.

17. The floormat of claim 15, wherein the said first and second channel flaps return to their original shape when the scrubber insert is fully urged into the scrubber insert chamber, for assisting in maintaining the said scrubber insert within the scrubber insert chamber, on completion of the assembly.

18. The floormat of claim 15, wherein the said walls of the bottom surface of the scrubber insert and the said curved channels form four boxes within the bottom surface of the said scrubber insert, wherein each of the said boxes has a first member and a second member, together forming a platform for stabilizing the scrubber insert.

19. The floormat of claim 18, wherein each of the said first and second members of the boxes formed by the curved channels has a first and second drainage channels which facilitate the movement of accumulated water under the floormat.

20. The floormat of claim 1, wherein the frame, the scrubber inserts and the scrubber insert chamber is square in shape.

21. The floormat of claim 1, wherein the frame, the scrubber inserts and the scrubber insert chamber is rectangular in shape.

* * * * *